US006446902B1

(12) United States Patent
Salvo

(10) Patent No.: US 6,446,902 B1
(45) Date of Patent: Sep. 10, 2002

(54) CORE AND SHAFT ASSEMBLY FOR A PRINTER

(75) Inventor: Pasquale J. Salvo, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/751,064

(22) Filed: Dec. 28, 2000

(51) Int. Cl.[7] ..... B65H 16/10; B65H 19/10; B65H 75/10; B65H 75/26

(52) U.S. Cl. ..... 242/597.6; 242/597.3

(58) Field of Search ..... 400/613; 242/597.3, 242/597.6, 571.4, 597.2

(56) References Cited

U.S. PATENT DOCUMENTS 6,273,360 B1 * 8/2001 Robinson ..... 242/596.7

FOREIGN PATENT DOCUMENTS

JP 59-186857 A * 10/1984

* cited by examiner

*Primary Examiner*—Daniel J. Colilla
(74) *Attorney, Agent, or Firm*—Ronald Reichman; Karin A. Russo; Angelo Chaclas

(57) ABSTRACT

This invention provides a core and shaft assembly that enables a user to place a core of web material onto the shaft in a position for feeding the web material. This invention provides a web material core with axially positioned areas that mate with a shaft that has upwardly protruding pins thereby preventing the shaft from rotating when a core with web material wound around it that will not work in the machine is placed on the shaft. The core onto which a web of material can be wound or supported has at least one axially extending slot. The slot extends from the end of the core and ends in the central portion of the core. The shaft subassembly comprises an inner shaft having notches and an outer shaft having spring-loaded pins. The spring-loaded pins mate with the notches on the inner shaft when a core, not designed for use by the given machine, is mounted onto the shaft. The shaft assembly will cease rotating thereby causing the core with the web material wound around it to stop rotating also. Another embodiment provides a core with web material wound around it that has axially extending grooves whereby the grooves extend an unequal distance from each end of the core toward the central portion. There is an indent at the end of the groove allowing the spring-loaded pins located on the outer shaft to engage. The upwardly protruding pins will mate with the indent and allow the core to rotate.

18 Claims, 5 Drawing Sheets

CORE AND SHAFT ASSEMBLY FOR A PRINTER

TECHNICAL FIELD

This invention relates to printers and, more particularly, to a core that has a web material wound around it and a shaft for supporting web materials that will rotate when web materials designed to use with the machine are used, but will not rotate if web materials not designed for use by the machine are used, or if the web material is loaded in a position in which the web of material will not work properly in the machinery.

BACKGROUND OF THE INVENTION

It is well-known to wind a web around the outer surface of a core and then mount the core onto a shaft for performing numerous operations, such as label printing. Typically, i.e., ink ribbons, labels, thermal transfer ribbons, etc. on continuous web substrate or the like are mounted onto the cores. The shafts will rotate in a direction to either remove or add web onto the core. An example of the foregoing is in a label printer wherein the inked ribbon is wound on a core and then is mounted onto a first shaft, past a printing station and connected to a driven take-up roller on a second shaft. Another example is a series of labels that are carried by a continuous web of a release liner which are successfully advanced over a platen which is wound around the outer surface of a core. The core containing the continuous web is mounted onto a shaft past a printing station and the continuous web is then connected to a take up roller on a second shaft.

There have been various prior art cores that are adapted to be removeably received on shafts. For instance, U.S. Pat. No. 5,947,618 issued to Keller et al. (hereinafter referred to as "Keller-1") discloses an improved core designed to be frictionally engaged onto the spindle to releasably hold the core in position on the spindle. The core has three abutment faces on the interior surface and one of the abutment faces is cooperable with an abutment on the shaft to hold the core in proper position. However, in Keller-1, the core and spindle disclosed do not prevent the shaft from rotating if the incorrect web material is used. When the incorrect web material is used, the shaft does not stop rotating, thereby preventing the machine from functioning properly.

Another core and shaft assembly is disclosed in U.S. Pat. No. 5,833,377 issued to Keller et al. (hereinafter referred to as "Keller-2") in which an improved core and an improved shaft are disclosed which are frictionally engaged by means of a spring finger. The core has an abutment face for limiting movement of the core onto the shaft as well as a ramp to releasably hold the core in position on the shaft. The Keller-2 patent discloses the interrelationship of the core and the shaft, but does not anticipate that the shaft will be inoperable with a core with web material mounted incorrectly in the machine. Again, there is no cessation of machine operation if a core with ink ribbon wound around it is mounted in the incorrect direction, or if a core with an incompatible ribbon wound there around for printing with that printer is mounted onto a shaft.

When a core with web material not designed for use with a particular machine is placed on. a shaft, significant disadvantages to the user may be evident which have not been solved by the prior art, such as excessive wear on the print head leading to premature failure of the print head, ribbon breakage due to incompatibility of the installed web material with the print head, and contamination of the web material leading to poor print quality. In the case of a thermal printer, cores of web material that comprise material that will not work properly in the machine can cause excessive wear of the print head. In thermal printing, the print head contacts the backcoating of the thermal transfer ribbon. Heat is transferred through the backcoating to melt the ink adhered to the opposite side of the ribbon. This causes the ink to be transferred onto the substrate in contact with the ribbon. A thermal printer ribbon has a back coating comprising a material that typically has a low coefficient of friction. Premature failure of the print head occurs when the back coating does not have a coefficient of friction that is compatible with the thermal print head, and when the backcoating repeatedly contacts the print head in the course of the thermal printing process. Also, the web material could break due to incompatibility of the ribbon with the temperature of the print head. If the print head is too hot for the ink ribbon that was incorrectly used, the web of ink ribbon would break when in contact with the heat of the thermal print head. Breakage of the ribbon due to incompatibility of the ribbon with the temperature of the print head leads to machine inoperability. In addition, when an inferior quality ink ribbon is used, a problem, such as contamination of the ribbon related to the varied manufacturing processes, could lead to premature wear of the print head and ultimate machine failure. Particles from contamination can be deposited on the print head. When the print head contacts a ribbon with foreign particles on the ribbon, the print head will be scratched when it contacts the ribbon. When the print head is scratched, inferior print quality as well as premature print head failure will occur. In the case of print quality, this could be substantial loss of revenue. There are specific printer applications, such as postal printing applications, which require higher levels of print quality and would result in loss of revenue when characters are not readable, i.e., a poorly printed postal indicia may have no value.

In the case of a label printer, a series of labels is carried by a web and is Is successfully advanced over a platen where each label is printed by a print head. After each label is printed, the carrier web is advanced around a delaminator where the printed label is peeled from the carrier web for application to an article. The web material with labels is wound around the core. When a core of web material with label stock having a greater or lesser thickness than the machine requires is used, jams occur in the continuous web feed path. Also, tension on the machine parts is experienced which contributes to machine failure. When cores of continuous webs of labels not specifically designed for use in the particular printer are placed on the shafts of the label printers for the label printing operation, the label stock can jam in the continuous web feed path. Machine jams can result from any of the following: premature release of labels from the carrier web, labels too thick to proceed along the tenuous paper path, or similar paper path failures.

A disadvantage of the prior art is that incorrect cores of web material can be placed on the shaft of the machine, and the machine will continue operating.

SUMMARY OF THE INVENTION

This invention overcomes the problems of the prior art by providing a core and shaft assembly that enables a user to place a core of web material onto the shaft in a position for feeding the web material. To accomplish the foregoing, this invention provides a web material core with axially positioned areas that mate with a shaft that has upwardly protruding pins thereby preventing the shaft from rotating when a core with web material wound around it that will not work in the machine is placed on the shaft.

In accordance with one embodiment of the invention is the combination of a core and a shaft. The core is generally tubular in shape onto which a web of material can be wound or supported and has at least one axially extending slot. The slot extends from the end of the core and ends in the central portion of the core. Also, the slot in the core is cut from the inner surface to the outer surface. The shaft subassembly comprises an inner shaft having notches and an outer shaft having spring-loaded pins. The spring1 loaded pins mate with the notches on the inner shaft when a core, which is not designed for use by the given machine, is mounted onto the shaft. In that case, the web material will no longer be advanced because the pins prevent the shaft from rotating. A core that has web material wound around it that is not compatible with the machine will not have slots positioned to mate with the pins present in the outer shaft on the machine. As the core with web material wound around it that is not compatible with the machine is placed onto the shaft, the pins located in the outer shaft on the machine will be forced downward into the notches, positioned below the pins on the inner shaft. When the pins are forced downward into the notches on the inner shaft, the shaft will only rotate to the point at which the notch end is reached. At this point, the shaft assembly will cease rotating, thereby causing the core with the web material wound around it to stop rotating.

The spring-loaded pins located in the outer shaft have two planar sides with a curved topside allowing a core to be slideingly mounted onto the shaft whilethe planar sides position the core on the shaft and prevent the core from rotating. A spring retainer portion on the pin positions the pin within the outer shaft.

An alternative embodiment is to provide a core with web material wound around it that has axially extending grooves whereby the grooves extend an unequal distance from each end of the core toward the central portion. There is an indent at the central portion position at the end of the groove, allowing the spring-loaded pins located on the outer shaft to engage. When the core is slideably mounted onto the shaft, the spring-loaded pins are forced upward into the groove of the core andwill ultimately lock the core into the operating position when the spring-loaded pins reach the indent at the end of the groove on the core.

DETAILED DESCRIPTION OF THE PREFERRED EMBODIMENT

Figure 1:
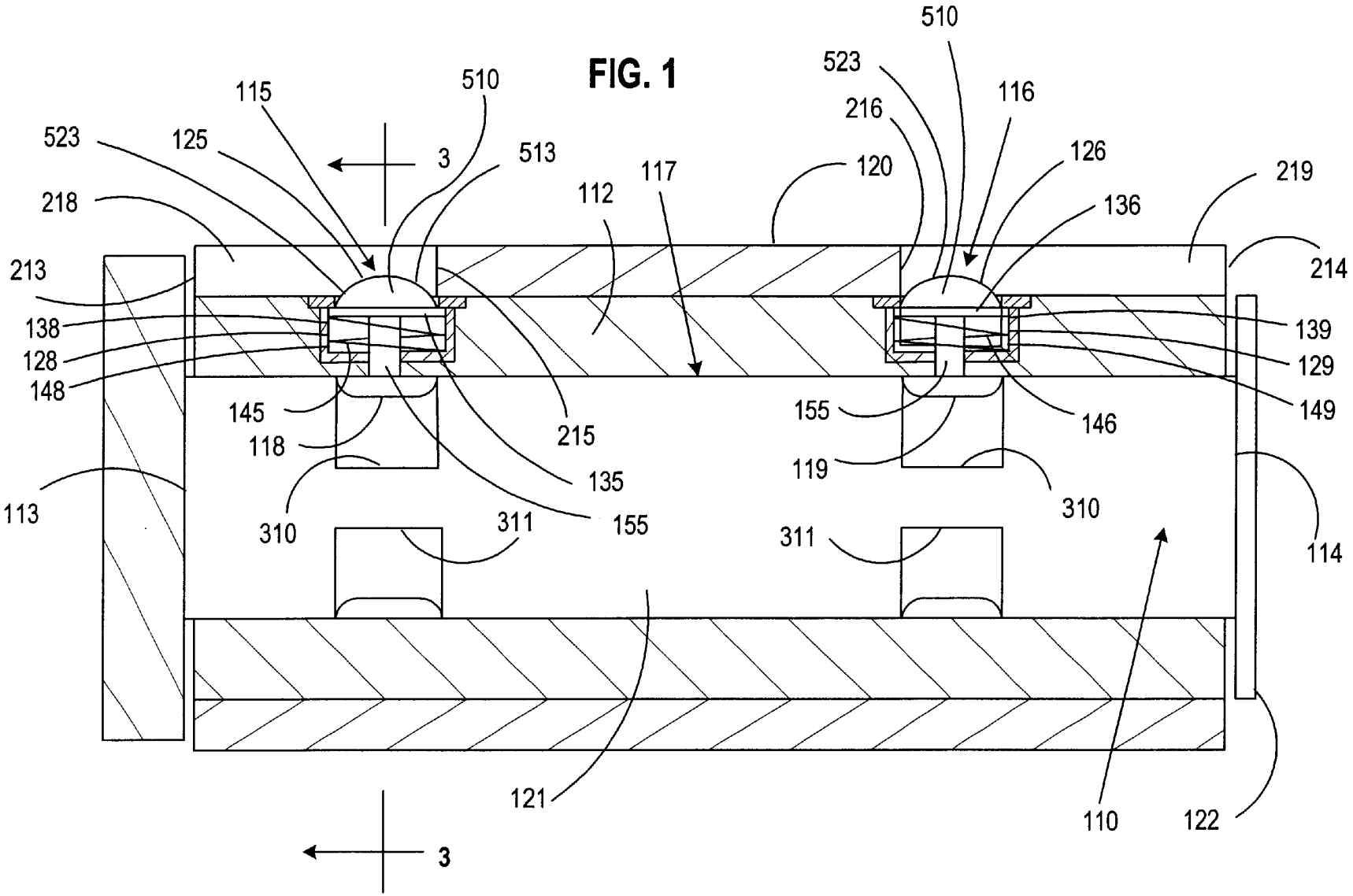
FIG. 1 is a sectional view of the core and shaft assembly showing the inner shaft, the outer shaft and a core with axially extending slots positioned.for correct operation.

In describing the preferred embodiment of the instant invention, reference is made to the drawing wherein there is seen in FIG. 1 a web material core 120 properly mounted on shaft assembly 110. A web of material such as.thermal ink ribbon, carrier web for labels, or ink ribbon is wound around web material core 120. Shaft assembly 110 includes inner shaft 117 and outer shaft 112 held in place by end plate 122. Web material core 120 is slideably mounted onto outer shaft 112. Outer shaft 112 has an outer surface adapted to receive web material core 120 and a hollow interior adapted to slideably rotate over inner shaft 117. Outer shaft 112 has a plurality of spring-loaded pins 115, 116 extending through the outer surface of outer shaft 112 to the inner surface of inner shaft 117. Spring-loaded pins 115, 116 correspond directly to notches 118, 119 in inner shaft 117. Inner shaft 117 is an elongated member having ends 113, 114 and a central portion 121 lying therebetween. There are a plurality of notches 118, 119 positioned on inner shaft 117. Notch 118 and notch 119 are positioned circumferentially on inner shaft 117. Notches 118, 119 extend from notch beginning 310 to notch end 311 whereby notches 118, 119 do not extend entirely around the circumference of inner shaft 117. The distance of notch 118 from first end 113 to notch 118 is not equal to the distance of notch 119 location which is from second end 114 to notch 119. Spring-loaded pins 115,116, located on outer shaft 112 also correspond to slots 218, 219 in web material core 120. Spring-loaded pins 115, 116 have an upward tension forcing spring-loaded pins 115, 116 upward through outer shaft 112. In this example, spring-loaded pins 115, 116 are positioned within slots 218, 219 to connect web material core 120 with outer shaft 112 to allow rotation of web material core 120.

Figure 2:
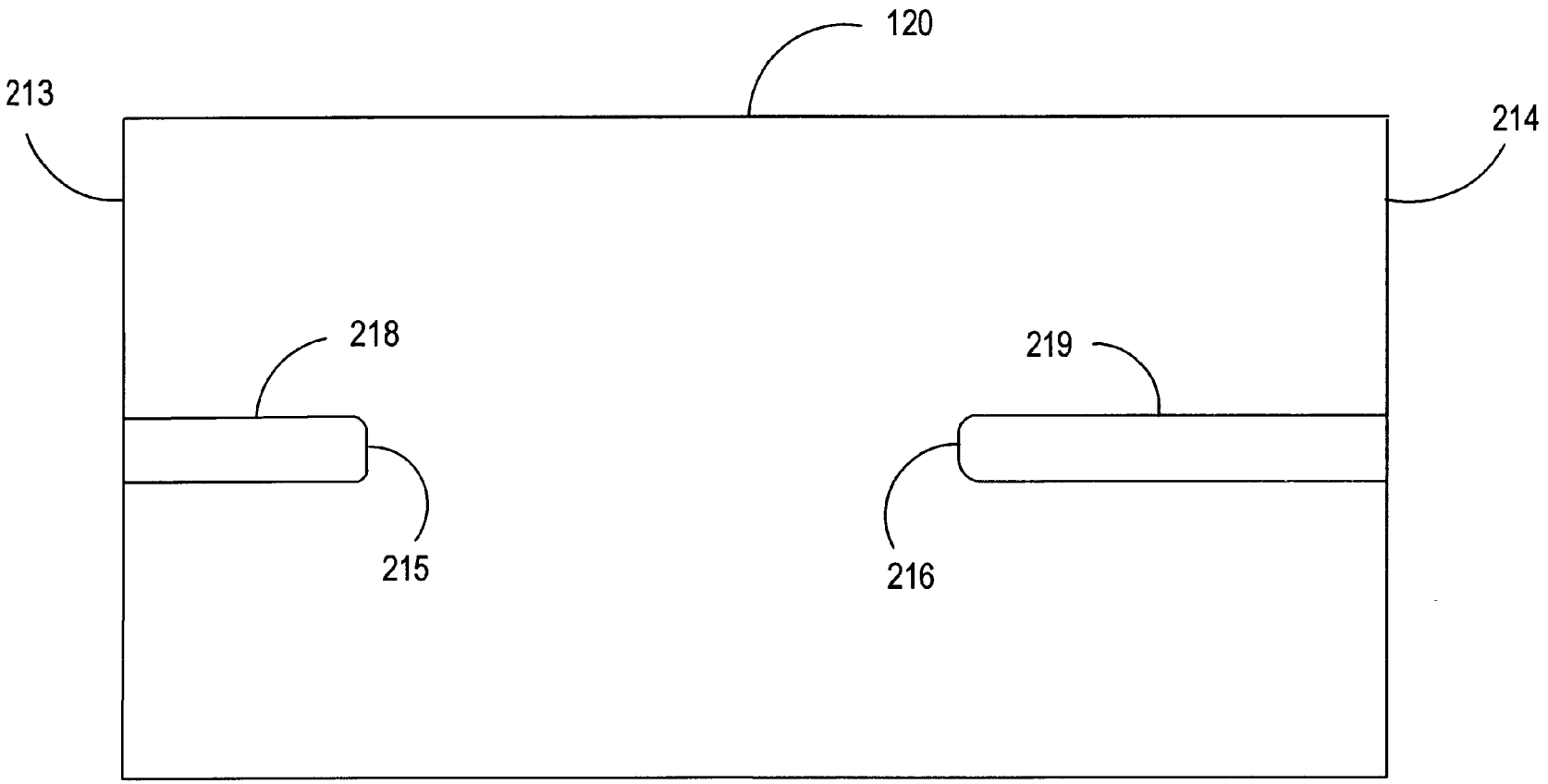
FIG. 2 is a plan view of the core showing the axially extending slots.

As shown in FIGS. 1 and 2, web material core 120 is generally a tubular member having first web material core end 213 and second web material core end 214. Web material core 120 has an outer surface onto which a web of material is adapted to be wound. Web material core 120 has a hollow interior adapted to receive a shaft. Web material core 120 has a plurality of axially extending slots 218, 219. Slot 218 extends from first web material core end 213 to slot end 215 which is a position that is not equal to the distance of slot 219 from second web material core end 214 to slot end 216. As shown in FIG. 1, spring-loaded pins 115,116 in outer shaft 112 correspond to notches 118, 119 in inner shaft 11.7 as well as with slots 218, 219 in web material core 120, respectively. "Slots" are areas cut from the inner surface to the outer surface. Slot 218 is positioned to allow spring-loaded pin 115 to extend freely through. Slot 219 is positioned to allow spring-loaded pin 116 to extend freely through. When web material core 120 is rotateably mounted onto shaft assembly 110, spring-loaded pins 115, 116 protrude through slots 218, 219, thereby enabling rotation of outer shaft 112 with web material core 120.

Figure 3:
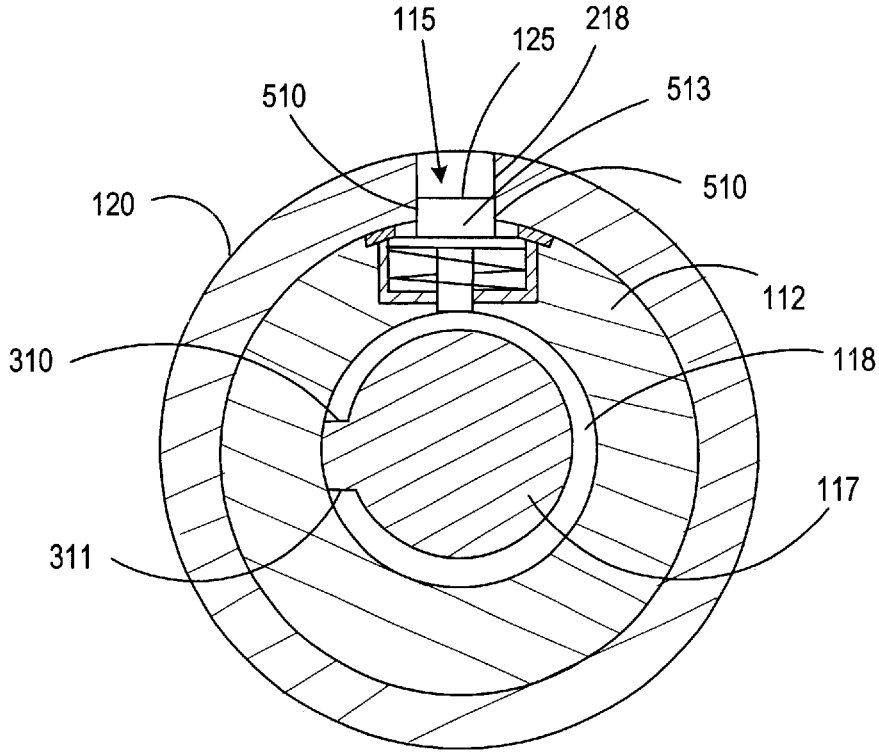
FIG. 3 is a sectional view of the core and shaft taken on the plane indicated by the line 3—3 in FIG. 1.

As shown in FIG. 3, the cross section view of notch 118 depicts a notch beginning 310 and notch end 311 in inner shaft 117. Spring-loaded pin 115 is forced upward into the opening created. by slot 218 when web material core 120 is mounted on outer shaft 112. As outer shaft 112 begins to rotate, pin 115 will remain in slot 218 and core 120 on shaft 112 rotates.

Figure 4:
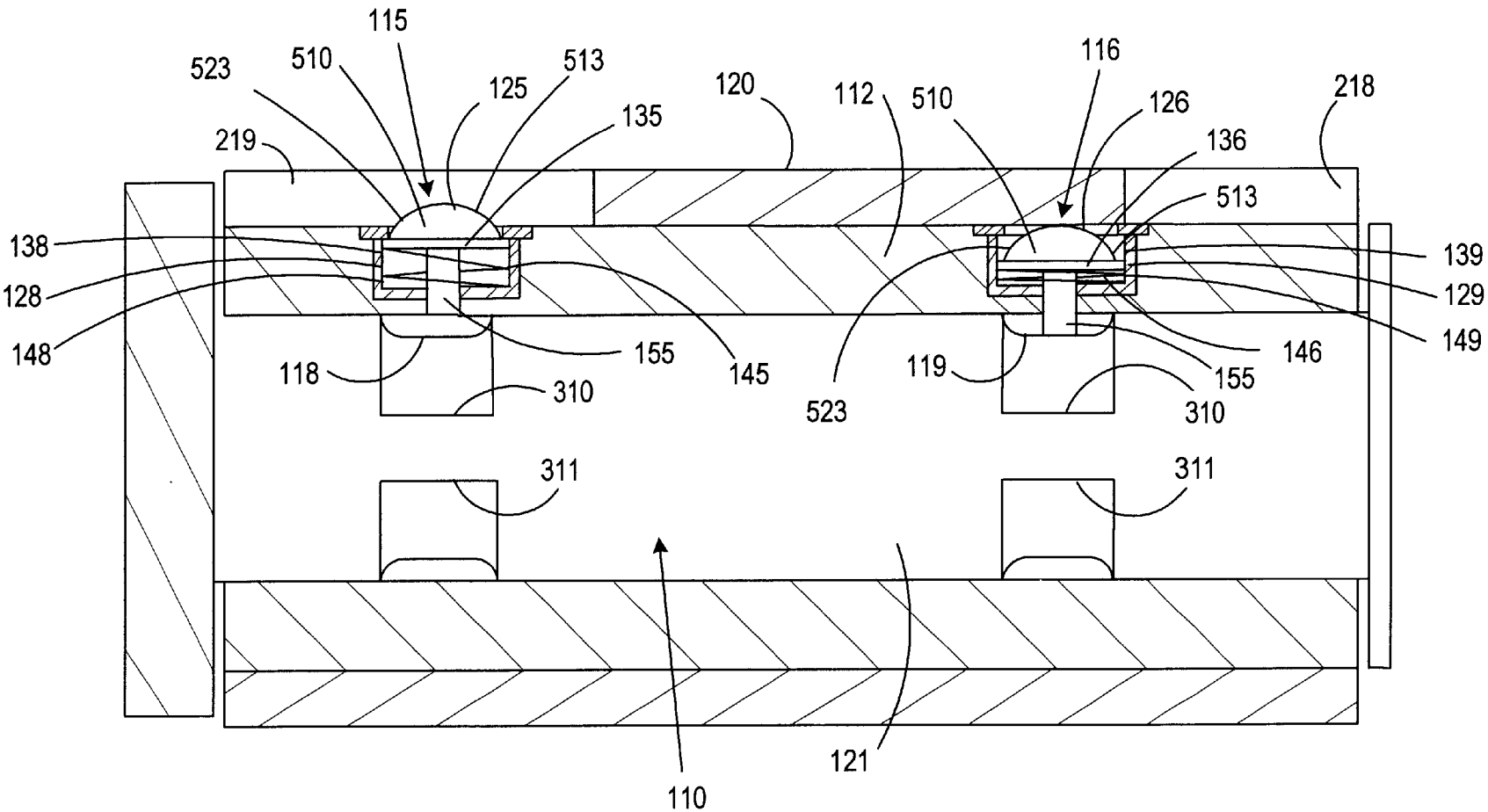
FIG. 4 is a sectional view of the core on the shaft in a position in which the web of material will not work in the machine.

However, when web material core 120 is mounted on outer shaft 112 in a position in which the web of material will not work in the machine, i.e., the web material core is positioned on the shaft backward, as shown in FIG. 4, spring-loaded pin 116 is depressed into notch 119. Therefore, as outer shaft 112 rotates, spring-loaded pin 116 moves circumferentially within notch 119 to notch end 311. When spring-loaded pin 116, which is depressed by the inner surface of core 120, reaches notch end 311, outer shaft 112 will cease rotation. When outer shaft 112 ceases rotation, the web material will no longer advance. Likewise, when a core with web material not specified or adequate for the machine is mounted on outer shaft 112,. spring-loaded pins 115 or 116 will depress into notches 118 and 119, respectively. A web material core which having web material which will not work in the machine can include, but is not limited to, any one of the following: a ribbon core with web material wound around it that is positioned on the shaft assembly in the wrong direction a ribbon core with web material wound around it that is not made to fit with the designated shaft assembly, a ribbon core with web material wound around it which is not the proper size.

Figure 5:
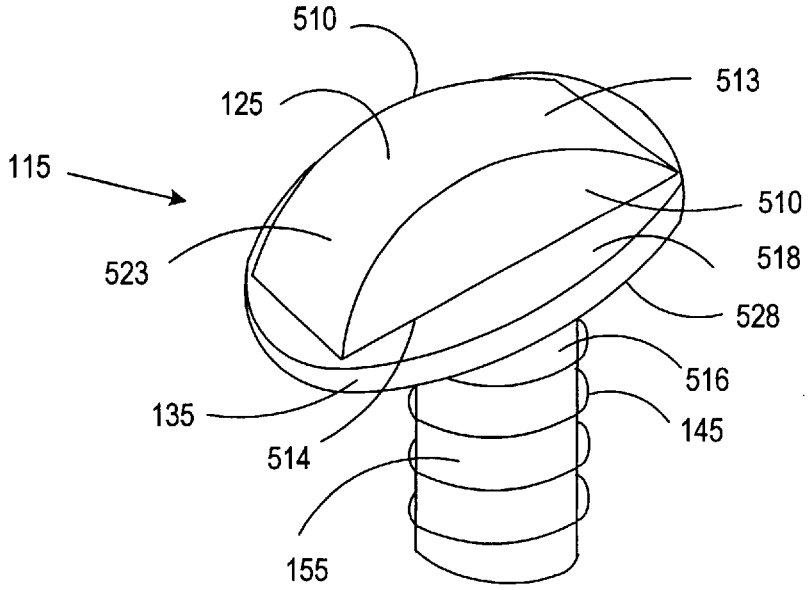
FIG. 5 is a perspective of the spring-loaded pin.

As shown in FIGS. 1 and 5, pin tops 125, 126 of spring-loaded pins 115, 116, respectively, have four sides. The four sides are shaped to permit the web material core 120 to be slideably mounted onto outer shaft 112 from end 114 to end 113, but provide resistance to movement of web material core 120 in the circumferential direction. Spring-loaded pin 115 is shown in FIG. 5 by example. Face 510 of spring-loaded pin 115 positioned parallel to the axis of rotation of outer shaft 112 is planar. This prevents web material core 120 from rotating around outer shaft 112 in either direction. Curves 513, 523 form a dome on spring-loaded pinl15 to allow web material core 120 to slide over pins 115,116. Curves 513 on spring-loaded pins 115, 116 allow web material core 120 to be slideably mounted onto outer shaft 112 in the direction of first end 113. Curve 523 on spring-loaded pin 115 allows web material core 120 to be slideably removed in the direction of second end 114. Lastly, bottom side 514 of pin is directly opposed to a midpoint of curved topsides 513 and 515, and is attached to a midpoint of spring retainer portions 135, 136.

Pin top 125 in FIG. 5, is shown to be separated from spring-loaded pin 115 by spring retainer portion 135. It is to be understood that the same features described for spring-loaded pin 115 are in spring-loaded pin 116. As shown in FIGS. 1 and 5, spring retainer portion 135 allows pin top 125 to protrude through the opening in outer shaft 112. When a correctly designated web material core 120 is slideably mounted onto outer shaft 112, pin top 125 mates in web material core 120 slot 218 due to the upward tension from spring 145. First side 518 of spring retainer portion 135 retains pin top 125 in outer shaft 112 at a height adequate for pin top 125 to mate with slot 218. A second opposing side 528 on spring retainer portion 135 is attached to pin first end 516. Spring retainer portion 135 extends beyond the edges of bottom side 514 of pin top 125. Pins 115, 116 are upwardly tensioned by spring 145, 146. Pins 115, 116 are positioned within spring 145, 146.

Spring-loaded pin 115 is positioned within chambers 128, 129. Chambers 128, 129 are located in the outer surface of outer shaft 112. Chambers 128, 129 can be a notch of sufficient dimensions to house spring-loaded pins 115, 116. Alternatively, the spring-biased pins 115, 116 in chambers 128, 129 can be fabricated of a material such as plastic or metal that can be placed into a pre-drilled area on outer shaft 112. Chambers 128, 129 have a depth sufficient to hold pin tops 125, 126 and springs 145, 146 when compressed due to contact of web material core 120 with pin tops 125, 126. Chambers 128, 129 comprise two sections. There is an upper part of chambers 138, 139, and there is a lower part of chambers 148, 149. The upper part of chambers 138, 139 has a sufficient opening for pin top portions 125, 126 to protrude through. The lower part of the chambers 148, 149 only allows the pins 115 and 116 to protrude through. The springs 145, 146 rest on the bottom of the inside part of lower part of the chambers 148, 149. Because the spring is contained between the upper part of chambers 138, 139 and the lower part of chambers 148, 149, the spring-loaded pins 115, 116 are forced upward. Because the pin tops 125, 126 are forced upward, the pins 115, 116 will not mate with notches 118, 119, respectively, thereby allowing outer shaft 112 to rotate.

When web material core 120 is placed on outer shaft 112, in the incorrect direction, pin tops 125, 126 are forced downward. Spring retainers 135, 136 compress springs 145, 146 as pins 115, 116 mate in notches 118, 119, respectively. The pins 155, 156 move cirnumferentially within notches 118, 119 until the pins 155, 156 reach notch end 311. At this point, outer shaft 112 will not be able to rotate; the web material will cease to advance, thereby halting machine operation.

Figure 6:
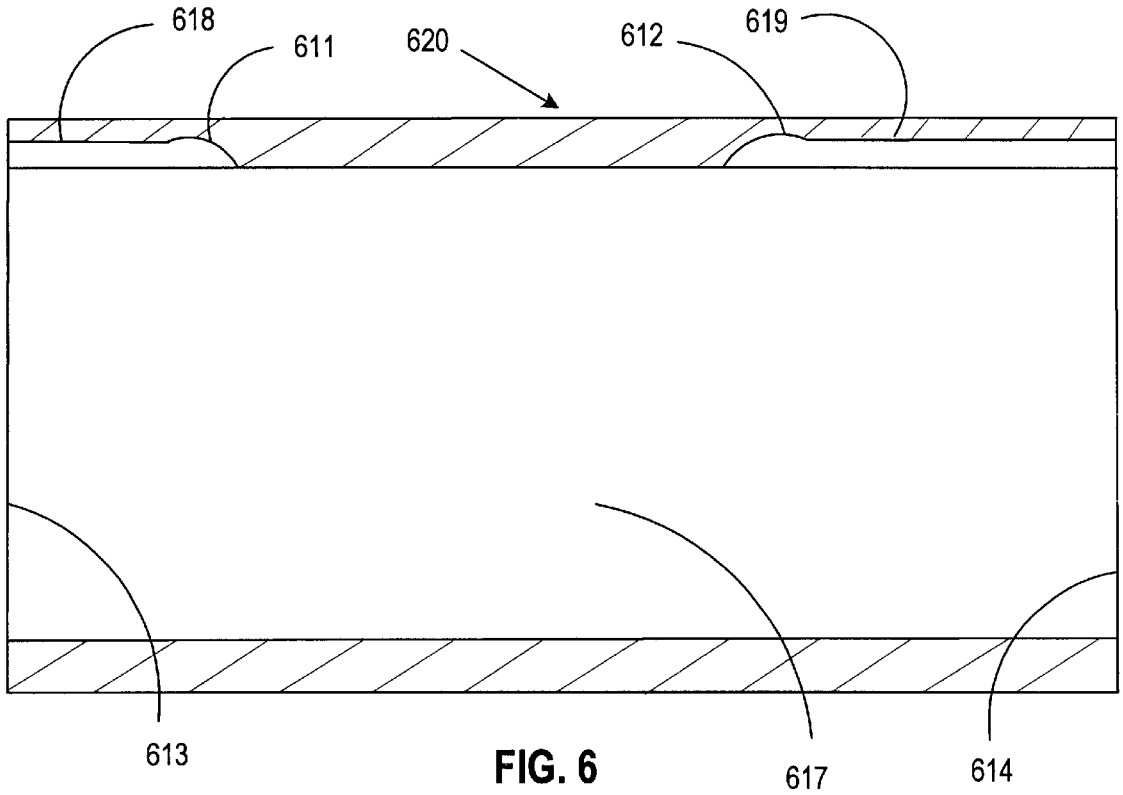
FIG. 6 is a sectional view of the core showing axially extending grooves.

As seen in FIG. 6, there is shown core 620 with axially extending grooves 618, 619 whereby grooves 618, 619 extend an unequal distance from, respectively, ends. 613 and 614 of the core toward central portion 617. There are indents 611, 612 at central portion 617 position of the end of grooves 618, 619, allowing spring-loaded pins 115, 116 to engage. When core 620 is slideably mounted onto shaft 112, spring-loaded pins 115, 116 are forced upward into groove 618, 619 of core 620 and will ultimately lock core 620 into the operating position when spring-loaded pins 115, 116 reach indents 611, 612 at the end of grooves 618, 619 on core 620.

Figure 7:
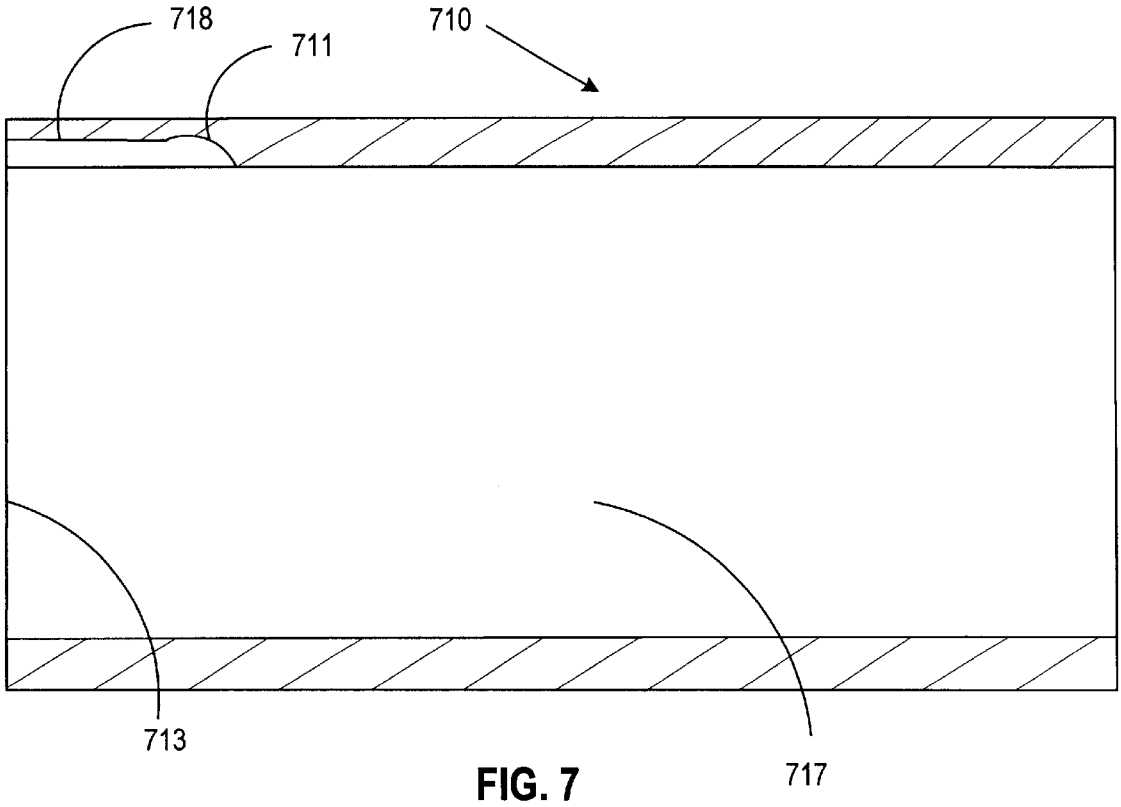
FIG. 7 is a sectional view of the core showing one axially extending groove.

Another embodiment of the core is shown in FIG. 7. This is core 710 that has one axially extending groove 718 extending from one end 713 of core 710 toward central portion 717. There is indent 711 at central portion 717 position of the end of groove 718 allowing spring-loaded pins 115, 116 to engage. When core 710 is slideably mounted onto outer shaft 112, spring-loaded pin 115 is forced upward into groove 718 of core 710 and will ultimately lock core 710 into the operating position when the spring-loaded pin 115 reaches indent 711 at the end of groove 718 on core 710.

It should be understood by those skilled in the art that various modifications may be made in the present invention without departing from the spirit and scope thereof, as described in the specification and defined in the appended claims.

What is claimed is:

1. A core and shaft assembly for use in a system supporting a web of material, said assembly comprising:

(a) a shaft subassembly, having a plurality of pins located on the outer surface of said shaft subassembly; and, (b) a core subassembly, wherein said core subassembly is generally tubular in shape and has a first end, a second end; and a central portion; and, wherein said core subassembly has:

(i) an outer surface upon which said web of material can be wound or supported;

(ii) a hollow interior adapted to receive said shaft subassembly; and, (iii) a plurality of areas on said core assembly that are axially extending areas positioned unequally about said core, wherein said core areas comprise a first area and a second area, said first area having a beginning at the core's first end and an end at the core's central portion, said second area having a beginning at the core's said second end and an end at the core's central portion, wherein each one of said areas is adapted to receive the pins located on the inner surface of said core between said first end and said second end, wherein each one of said plurality of areas can be mated with a corresponding pin on said shaft subassembly so that said core subassembly can be properly positioned relative to said shaft subassembly allowing said shaft subassembly to rotate within said core subassembly and when said areas are not mated with said pins, said pins prevent said subassembly from rotating.

2. The core and shaft assembly in accordance with claim 1, wherein said areas on said coreassembly are cut from the inner surface to the outer surface.

3. The core and shaft assembly in accordance with claim 2, wherein said areas on said core assembly comprise a first axially extending slot and a second axially extending slot, said first axially extending slot extending from said first core end to said central portion on said core, and, the second axially extending slot extending from said second core end to said central portion on said core.

4. The core and shaft assembly in accordance with claim 1, wherein said areas are positioned equally from said first end and said second end.

5. The core and shaft assembly in accordance with claim 1, wherein each one of said areas on said core assembly are axially extending areas positioned unequally about said core.

6. The core and shaft assembly in accordance with claim 5, wherein said core areas comprise a first area and a second area, said first area having a beginning at the core's said first end and an end at the core's said central portion, said second area having a beginning at the core's said second end and an end at the core's, said central portion.

7. The core and shaft assembly in accordance with claim 6, wherein said areas on said core assembly are axially extending grooves, said grooves extending from said core end and having an indent at a groove end in the central portion.

8. The core and shaft assembly in accordance with claim 1, wherein said shaft assembly comprises an elongated inner shaft and a tubular outer shaft.

9. The core and shaft assembly in accordance with claim 8, wherein said inner shaft has an outer surface lying between a first end and a second end and a central portion relative thereto.

10. The core and shaft assembly in accordance with claim 8, wherein said inner shaft has a plurality of notches located on said outer surface extending circumferentially relative to said outer surface of said inner shaft from a notch beginning to a notch end.

11. The core and shaft assembly in accordance with claim 10 wherein said notches are positioned in a plurality of locations around said inner shaft.

12. The core and shaft assembly in accordance with claim 8, wherein said pins on said outer shaft are spring-loaded and correspond directly to a notch in said inner shaft.

13. The core and shaft assembly in accordance with claim 12, wherein said pins have tension, said tension is directed outwardly relative to said shaft subassembly.

14. The core and shaft assembly in accordance with claim 8, wherein said tubular outer shaft has an outer surface adapted to receive the core assembly and a hollow interior adapted to mount on and slideably rotate over said inner shaft.

15. The core and shaft assembly in accordance with claim 8, wherein said outer shaft has a plurality of spring-loaded pins extending therethrough and correspond directly to a notch in said inner shaft.

16. The core and shaft assembly in accordance with claim 15, wherein each one of said spring-loaded pins comprises a top portion, a spring retainer portion, a pin portion, and a spring:

(a) said top portion further comprising at least four sides; said four sides further comprising:
  (i) a first planar side;
  (ii) a second planar side opposed to said first planar side;
  (iii) a curved top side, lying between said first planar side and said second planar side; and
  (iv) a bottom side attached to said shaft, whereon a midpoint of said bottom side is directly opposed to a midpoint of said curved top side;

(b) said spring retainer portion comprising two planar sides; said two planar sides further comprising:
  (i) a first side extending beyond the edges of said bottom side, supporting said pin top portion of said spring-loaded pin,
  (ii) a second side opposed to said first side and connected to said pin portion whereby said spring retainer portion supports upper portion:; of spring.

(c) said pin portion comprising two ends, said two ends further comprising:
  (i) a first end, said first end connected to said spring retainer portion; and,
  (ii) a second end, said second end extends a distance from inside surface of said outer shaft to inside surface of said notch on said inner shaft, and (d) said spring extending from said second side of said spring retainer to a position above said second end on said pin.

17. The core and shaft assembly in accordance with claim 16, wherein said spring-loaded pins are located within a chamber in said outer shaft, said chamber comprising:

(a) an upper chamber, said upper chamber having an aperture for said top portion of said spring-loaded pin to protrude and mate with said area on said core, and, (b) a lower chamber, said lower chamber having an aperture for said pin to protrude and mate with said notch on said inner shaft.

18. The core and shaft assembly in accordance with claim 15, wherein each one of said spring-loaded pins comprises a top portion, a spring retainer portion, and a pin portion:

(a) said top portion further comprising at least four sides; said four sides further comprising:
  (i) a first planar side;
  (ii) a second planar side opposed to said first planar side;
  (iii) a curved top side, lying between said first planar side and said second planar side; and,
  (iv) a bottom side attached to said shaft, whereon a midpoint of said bottom side is directly opposed to a midpoint of said curved top side;

(b) said spring retainer portion comprising two planar sides; said two planar; sides further comprising:
  (i) a first side extending beyond the edges of said bottom side, supporting said pin top portion of said spring-loaded pin,
  (ii) a second side opposed to said first side and connected to said pin portion whereby said spring retainer portion supports-upper portion: of spring.

(c) said pin portion comprising two ends, said two ends further comprising:
  (i) a first end, said first end connected to said spring retainer portion; and,
  (ii) a second end, said second end extends a distance from inside surface of said outer shaft to inside surface of said notch on said inner shaft.

(d) said spring extending from said second side of said spring retainer to a position above said second end on said pin.

* * * * *